US007915555B2

(12) United States Patent
Schneider et al.

(10) Patent No.: US 7,915,555 B2
(45) Date of Patent: Mar. 29, 2011

(54) ROTARY DRIVE FOR AN ELECTRICAL SWITCH WITH TOGGLE-LEVER ACTUATION

(75) Inventors: Bernd Schneider, Bonn (DE); Walter Gilgen, Koenigswinter (DE); Klaus-Dieter Nuerenberg, Koenigswinter (DE); Bernd Howald, Bonn (DE)

(73) Assignee: Eaton Industries GmbH, Bonn (DE)

( * ) Notice: Subject to any disclaimer, the term of this patent is extended or adjusted under 35 U.S.C. 154(b) by 369 days.

(21) Appl. No.: 12/160,740

(22) PCT Filed: Dec. 20, 2006

(86) PCT No.: PCT/EP2006/012275

§ 371 (c)(1),
(2), (4) Date: Jul. 11, 2008

(87) PCT Pub. No.: WO2007/087881

PCT Pub. Date: Aug. 9, 2007

(65) Prior Publication Data

US 2010/0163381 A1 Jul. 1, 2010

(30) Foreign Application Priority Data

Jan. 11, 2006 (DE) ..... 10 2006 001 404

(51) Int. Cl.
*H01H 9/20* (2006.01)

(52) U.S. Cl. ..... 200/331; 200/334

(58) Field of Classification Search ..... 200/331
See application file for complete search history.

(56) References Cited

U.S. PATENT DOCUMENTS

| | | | | |
|---|---|---|---|---|
| 3,752,947 | A | 8/1973 | Strobel | |
| 5,019,676 | A * | 5/1991 | Heckenkamp | 200/50.18 |
| 5,319,168 | A * | 6/1994 | Hutko et al. | 200/331 |
| 6,437,262 | B1 | 8/2002 | Gupta et al. | |

FOREIGN PATENT DOCUMENTS

| | | |
|---|---|---|
| DE | 2808585 | 8/1979 |
| DE | 4300313 | 3/1994 |
| DE | 4322214 | 1/1995 |
| DE | 4322215 | 1/1995 |
| EP | 0067128 | 12/1982 |
| FR | 2572579 | 5/1986 |

* cited by examiner

*Primary Examiner* — Renee S Luebke
*Assistant Examiner* — Lisa Klaus
(74) *Attorney, Agent, or Firm* — Leydig, Voit & Mayer, Ltd.

(57) ABSTRACT

A rotary drive for a switch actuated by a toggle lever includes an operative connection which swivels, a first catch element on the operative connection, coupled to the toggle lever, and a second catch element on the operative connection. A mounting plate parallel to the switch base and a rotatable shaft are provided, the rotatable shaft disposed through the mounting plate. The rotary drive further includes a swivel arm on the shaft, a rotary knob coupled to the shaft configured to rotate the shaft. A mechanical connection couples the swivel arm to the second catch element, converting movement of the shaft into a movement of the operative connection. A swivel movement of the toggle lever is transferred to the second catch element, and the swivel arm enables the operative connection to swivel through a rotation of the shaft to move the toggle lever.

12 Claims, 2 Drawing Sheets

ROTARY DRIVE FOR AN ELECTRICAL SWITCH WITH TOGGLE-LEVER ACTUATION

CROSS REFERENCE TO PRIOR RELATED APPLICATIONS

This is a U.S. National Phase application under 35 U.S.C. §371 of International Application No. PCT/EP2006/012275, filed on Dec. 20, 2006, and claims the benefit of German Patent Application No. 10 2006 001 404.9, filed on Jan. 11, 2006. The International Application was published in German on Aug. 9, 2007 as WO 2007/087881 A1 under PCT Article 221(2).

FIELD

The invention relates to the field of electrical switches and in particular, relates to a rotary drive for an electrical switch that can be actuated by a toggle lever.

BACKGROUND

A rotary drive for a switch with a snap-action mechanism is described, for example, in German patent application DE 2808585 A1. This arrangement is employed to execute the (translatory) toggling movement of a toggle lever that actuates the snap-action mechanism by means of a rotational movement. In order to do this, the toggle lever is gripped by a rotary lever, for which purpose there is a recess in the rotary lever. The rotary lever is swivel-mounted on the actuation side of the housing cover of the electrical switch.

German patent specification DE 4300313 C1 describes another proposal for the execution of the toggle movement of a toggle lever on a switch by turning a handle that is rotatably mounted on an actuating shaft.

Generally, important switches on operating panels or switching cabinets should be accessible from the outside. A problem arises when such a switch cannot be placed on or in the housing wall and instead, the switch is at a distance behind the wall and should nevertheless be actuatable from the outside. In the case of a switch with rotary-knob, the axis of rotation can be extended, easily passing through the wall. With respect to situations with toggle switches, the switches cannot easily pass through the wall. The only option available is to cut a disproportionately large opening in the wall, provided that a passage through the wall is at all permissible. For such or similar installation situations, it is desirable if an electrical switch with toggle-lever actuation can also be actuated by being turned.

SUMMARY

It is an aspect of the present invention to provide a device with which a switch with toggle-lever actuation can also be actuated by means of a rotary drive.

The present invention provides a rotary drive for an electrical switch attached to a switch base and actuated by a toggle lever having a first end position and a second end position, the toggle lever being disposed at a front of the switch and being swivelable about a first axis of rotation. The rotary drive includes an operative connection having a first portion and a second portion, the operative connection being swivelable about a second axis of rotation, the first axis of rotation and the second axis of rotation approximately coinciding. The rotary drive further includes a first catch element disposed on the first portion of the operative connection, the first catch element being coupled to the toggle lever, and a second catch element disposed on the second portion of the operative connection at a back of the switch. A mounting plate and a rotatable shaft are provided, the mounting plate disposed parallel to the switch base, and the rotatable shaft disposed through the mounting plate. The rotary drive further includes a swivel arm disposed on the shaft, a manual rotary knob coupled to the shaft and configured to rotate the shaft, and a mechanical connection coupling the swivel arm and the second catch element and configured to convert a rotational movement of the shaft into a swiveling movement of the operative connection. A swivel movement of the toggle lever is transferred into a swivel movement of the second catch element, and a length of the swivel arm is configured so as to enable the operative connection to be swiveled to an extent of a rotation of the shaft so as to move the toggle lever from the first end position to the second end position.

BRIEF DESCRIPTION OF THE DRAWINGS

The present invention will be more readily understood from the detailed description of exemplary embodiments presented below considered in conjunction with the accompanying drawings, in which.

DETAILED DESCRIPTION

Figure 2:
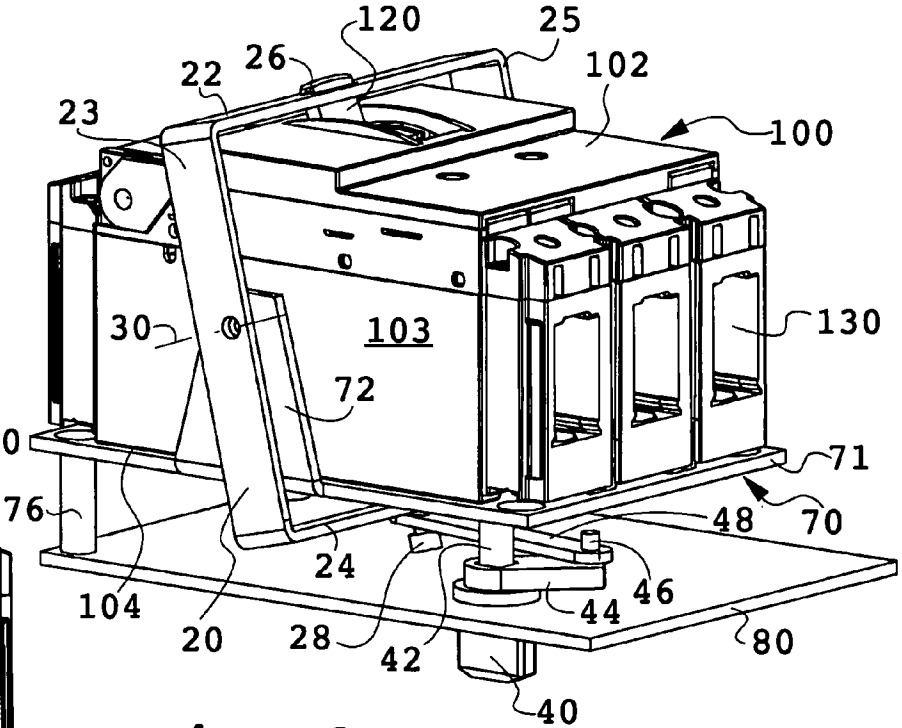
FIG. 2 is a perspective view with a frame as the operative connection in accordance with an embodiment of the present invention.

An embodiment according to the present invention is directed to a rotary drive for an electrical switch that is actuated by a toggle lever. The rotary drive includes a rotatably mounted operative connection configured as a frame or clip between the toggle switch and the rotary knob, whose rotation follows the movement of the toggle lever, or which can be actuated by the movement of the operative connection of the toggle lever. A catch arrangement between a shaft situated in a mounting plate and the operative connection serve to actuate the toggle lever and thus the lock of the switch into the appertaining end position.

According to an aspect of the present invention, the rotary drive can easily be actuated from the back, if the front of the built-in switch is difficult or impossible to access. Moreover the actuation from the front remains unhindered.

The rotary knob generally follows the movement of the toggle lever, so that the various positions of the toggle lever are "mirrored" in various positions of the rotary knob and vice versa. An aspect for the function of a low-voltage switch is that the lock of the switch may have to be reset after it has been tripped. After being tripped, the toggle lever and the rotary knob are in a center position. This position indicates the tripped state to the user. Turning the switch on again by means of the rotary knob is only possible after the lock has been reset. In this context, it is advantageous if the function features (ON, OFF, tripped) are printed or engraved next to the rotary knob so that they are visible to the user.

The first catch element located on the front of the switch can be configured as a catch opening. When a clip is used, the end of the upper leg of the clip can also be configured as a fork that surrounds the end of the toggle lever, rather than being configured as a catch opening.

The mechanical operative connection can be configured in various advantageous exemplary embodiments. Firstly, the operative connection can consist of a U-shaped clip on whose first leg the first catch element is formed and on whose second leg the second catch element is formed, and the legs, each bent at a right angle, are arranged on a clip bar that moves around the axis of rotation. Secondly, the operative connection can consist of a right-angled frame that surrounds the front, back and two parallel sides of the switch, and the first catch element is formed on the first frame strut located on the front of the switch while the second catch element is formed on the second frame strut located on the back of the switch, and the axis of rotation runs through the frame struts that surround the parallel sides of the switch.

The second catch element located on the back of the switch can be configured as an elongated hole. The mechanical connection here consists of a catch pin that is situated on the swivel shaft and that extends through the elongated hole. As an alternative to this, the second catch element can also be configured as a catch pin, whereby the mechanical connection consists of a rod that connects the catch pin and the swivel shaft in an articulated manner, as a result of which a rotational movement of the shaft can be converted into a swiveling movement of the frame.

Advantageously, the switch is moved into its two end positions by means of a snap-action mechanism.

The mounting plate can be configured as part of a door or flap of a switching cabinet, as a result of which the switch becomes accessible from the back when the flap is opened. Here, an alternative for the mounting of the rotary knob and shaft has to be provided. For instance, the rotary knob can be mounted in the mounting plate configured as a flap in such a manner that it is disengaged from the shaft when the flap is opened. The connection between the rotary knob and the shaft can be configured as a plug-in connection, so that, when the flap is swiveled away, the rotary knob moves along with it, disengaging from the shaft in the process. When the flap is swiveled back in, the rotary knob once again engages with the shaft.

Various solutions can be employed to hold the switch in the switching cabinet. One solution is shown in the figures and is described in greater detail there. Another solution can be that the switch holder consists of a stamped and bent component in which the spacers are not configured separately as individual parts. Such embodiments should be easy for a person skilled in the art to implement. An aspect of the present invention provides that the catch elements are properly secured and that the distances are sufficient between the switch holder and the mounting plate, which can also be the back wall of a switching cabinet.

Figure 1:
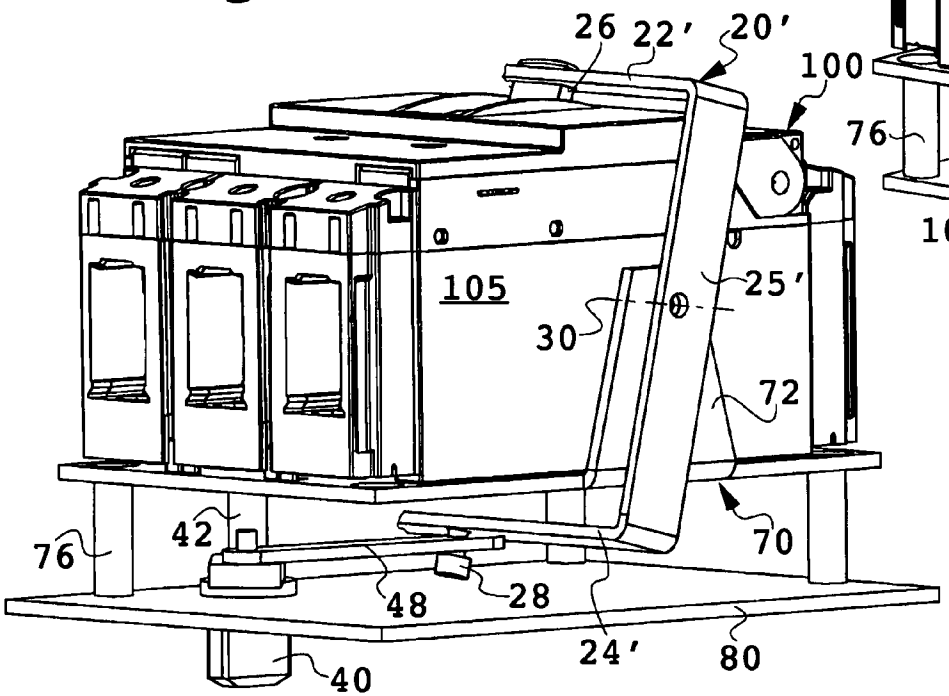
FIG. 1 is a perspective view of with clip as the operative connection in accordance with an embodiment of the present invention.

FIGS. 1 and 2 depict the following details of the arrangement according to the invention: the back 104 of an electrical switch 100 rests on a switch base 71 and can be affixed thereto in a detachable manner. A toggle lever 120 is visible on the front 102 of the switch 100. Openings 130 that provide access to the terminals are drawn on the right-hand side of the switch. The switch base includes a plate 71 that lies parallel to the back wall 104 of the switch. The plate (base surface 71) is positioned at a distance from the mounting plate 80 by means of supports or spacers 76. The distance established is such that the catch arrangement having the reference numerals 44, 46, 48, 28 has sufficient space between the base surface 71 and the mounting plate 80. A flange 72 is formed on both sides of the switch on the switch base 70. In FIG. 1, a clip 20' is attached to the flange 72 so that it can rotate around the axis 30. In FIG. 2, a frame 20 is mounted on the flange 72 so that it can rotate around the axis 30.

The frame in FIG. 2 is rectangular and has four frame struts 22, 23, 24 and 25. The frame struts surround the front 102, the back 104 and two parallel sides 103, 105 of the switch 100. The axis of rotation 30 of the frame 20 coincides precisely or approximately with the axis of rotation (located inside the switch) of the toggle lever 120. A rectangular catch opening 26 is formed in the first frame strut 22 located on the front 102 of the switch 100, and the end of the toggle lever 120 engages into this catch opening 26. A catch 28 is formed on the second frame strut 24 located on the back 104 of the switch 100. The mounting plate 80 is parallel to the switch base 71, and a shaft 42 that can be rotated from the outside by means of a manual rotary knob 40 passes through said mounting plate. This mounting plate can also be a housing wall of a switching cabinet or the like.

Arranged on the shaft 42 is a swivel arm 44 that transmits a rotary movement between the swivel arm 44 and the frame catch 28 via the rod 48. The length of the swivel arm is dimensioned in such a way that the frame can be (completely) swiveled over the extension of the path of rotation of the shaft 42 (or of the manual rotary knob) in such a manner that the toggle lever can be moved from one of its end positions to its other end position. Since the axial position of the frame is approximately flush with the axis of the toggle lever, the toggle lever remains on the first frame strut 22 in the catch opening 26. The frame strut and the toggle lever execute the same circular arc movement.

In FIG. 1, the clip 20' includes clip legs 22', 24', 25' and is configured as an operative connection between the toggle switch 120 and the rotary knob 40. In contrast to the frame 20 according to FIG. 2, the clip 20' has only one bearing on the axis 30 on the flange 72. The clip legs 22' and 24' are shorter than the frame struts 22 and 24; they only extend so far as to accommodate the front end of the toggle switch and the catch 28 on the back. The catch opening 26 on the front can be configured as an opening enclosed all around or as a fork.

Figure 3:
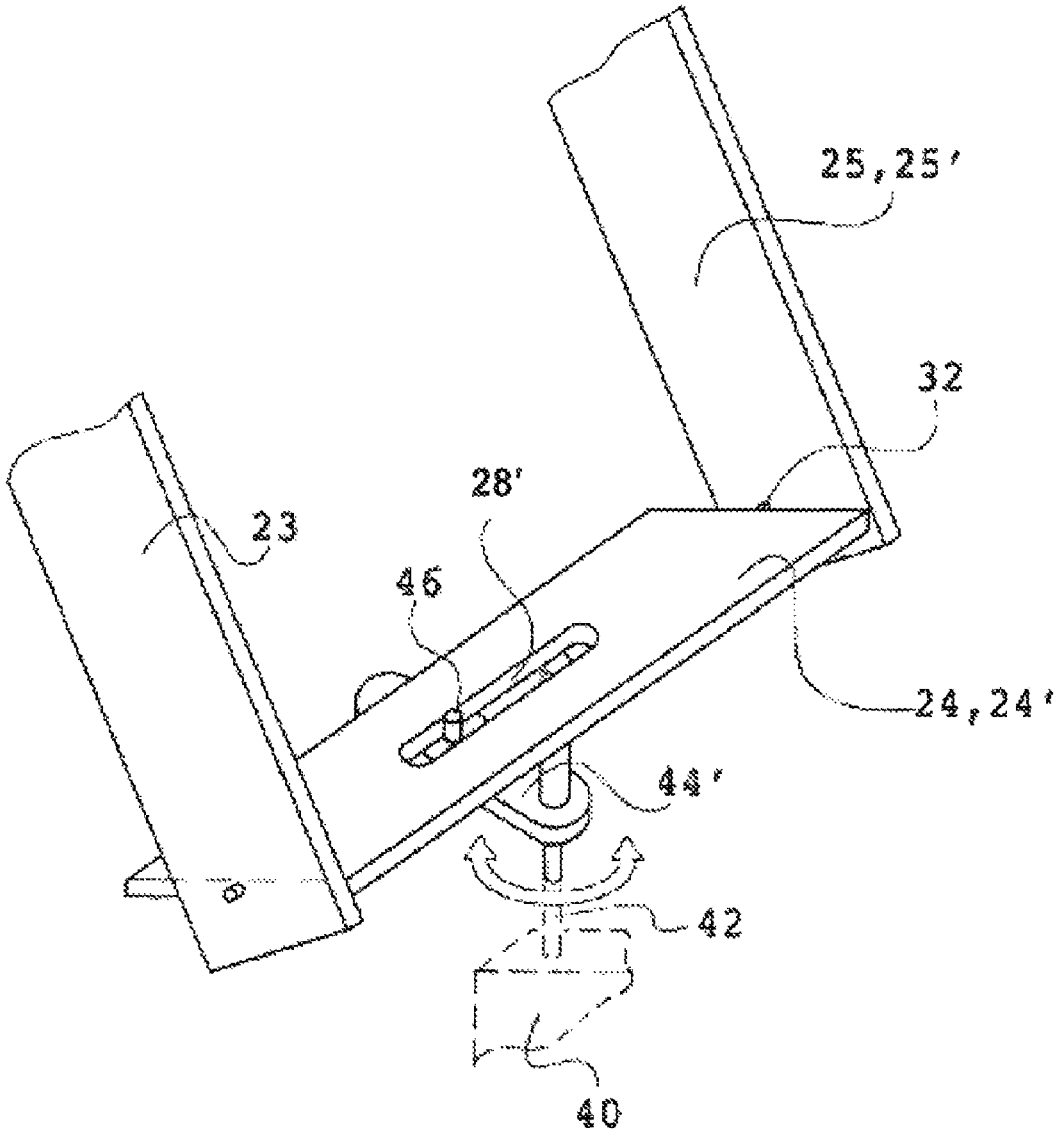
FIG. 3 is an illustration of a lower frame strut mounted so as to swing in accordance with an embodiment of the present invention.

FIG. 3 shows an exemplary embodiment that can be created when the switch 100 is installed horizontally or with a horizontal positioning of the switch holder. Here, the clip leg 24' located on the back 104 of the switch 100, or else the frame strut 24 located on the back 104 of the switch 100 should remain in the horizontal position when the clip 20' or the frame 20 is swiveled. For this purpose, said lower clip leg 24' or said lower frame strut 24 is rotatably mounted in a shaft 32. The drawing depicts the situation for the mounting of the frame strut 24 (but not for the mounting of the lower clip leg 24'). A person skilled in the art can easily understand and execute the embodiment that is not shown here. The catch arrangement on the bottom frame strut 24 is configured as an elongated hole 28'. The pin 46 formed on the swivel arm 44' extends through the elongated hole. When the shaft 42 turns, the swiveling pin 46 moves the bottom frame strut 24 or clip leg 24'. By the same token, the frame acted upon from the toggle lever side moves the pin 46, the swivel arm 44' and the rotary knob 40.

FIG. 3 shows an exemplary embodiment that can be created when the switch 100 is installed horizontally or with a horizontal positioning of the switch holder. Here, the clip leg 24' located on the back 104 of the switch 100, or else the frame strut 24 located on the back 104 of the switch 100 should remain in the horizontal position when the clip 20' or the frame strut 24 is swiveled. For this purpose, said lower clip leg 24' or said lower frame strut 24 is rotatably mounted in a shaft 32. The drawing depicts the situation for the mounting of the frame strut 24 (but not for the mounting of the lower clip leg 24'). A person skilled in the art can easily understand and execute the embodiment that is not shown here. The catch arrangement on the bottom frame strut 24 is configured as an elongated hole 28'. The pin 46 formed on the swivel arm 44' extends through the elongated hole. When the shaft 42 turns, the swiveling pin 46 moves the bottom frame strut 24 or clip leg 24'. By the same token, the frame acted upon from the toggle lever side moves the pin 46, the swivel arm 44' and the rotary knob 40.

The present invention is not limited to the embodiments described herein; reference should be had to the appended claims.

The invention claimed is:

1. A rotary drive for an electrical switch attached to a switch base and actuated by a toggle lever having a first end position and a second end position, the toggle lever being disposed at a front of the switch and being swivelable about a first axis of rotation, the rotary drive comprising:

an operative connection having a first portion and a second portion, the operative connection being swivelable about a second axis of rotation, the first axis of rotation and the second axis of rotation approximately coinciding;

a first catch element disposed on the first portion of the operative connection, the first catch element being coupled to the toggle lever;

a second catch element disposed on the second portion of the operative connection at a back of the switch;

a mounting plate disposed parallel to the switch base;

a rotatable shaft disposed through the mounting plate;

a swivel arm disposed on the shaft;

a manual rotary knob coupled to the shaft and configured to rotate the shaft; and a mechanical connection coupling the swivel arm and the second catch element and configured to convert a rotational movement of the shaft into a swiveling movement of the operative connection;

wherein a swivel movement of the toggle lever is transferred into a swivel movement of the second catch element, and wherein a length of the swivel arm is configured so as to enable the operative connection to be swiveled to an extent of a rotation of the shaft so as to move the toggle lever from the first end position to the second end position.

2. The rotary drive according to claim 1, wherein the first catch element includes at least one of a catch opening and a fork configured so that an end of the toggle lever projects therethrough.

3. The rotary drive according to claim 1, wherein the operative connection includes a U-shaped clip having a first leg, a second leg, and a clip bar, the first leg including the first portion, and the second leg including the second portion, the clip bar being disposed between the first leg and the second leg and being configured to swivel about the first axis of rotation.

4. The rotary drive according to claim 3, wherein the second catch element includes an elongated hole, and the mechanical connection includes a catch pin disposed on a swivel shaft and extending through the elongated hole.

5. The rotary drive according to claim 3, wherein the second catch element includes an elongated hole.

6. The rotary drive according to claim 3, wherein the second leg is coupled to the clip bar via a shaft so that the second leg remains in a horizontal position when the switch is disposed horizontally and the operative connection is swiveled.

7. The rotary drive according to claim 1, wherein the operative connection includes a right-angled frame that surrounds the electrical switch, the right-angled frame having a first, a second, a third, and a fourth frame strut, wherein the first frame strut is disposed at the front of the switch and includes the first portion, the second frame strut is disposed at the back of the switch and includes the second portion, the third and fourth frame struts run parallel to parallel sides of the switch, and the second axis of rotation runs through the third and the fourth frame struts.

8. The rotary drive according to claim 7, wherein the second catch element includes an elongated hole.

9. The rotary drive according to claim 7, wherein the second frame strut is coupled to the third and fourth frame struts so that the second frame strut remains in a horizontal position when the switch is disposed horizontally and the operative connection is swiveled.

10. The rotary drive according to claim 1, wherein the second catch element includes a catch pin, and the mechanical connection includes a rod and a swivel shaft, the rod coupling the catch pin and swivel shaft in an articulated manner.

11. The rotary drive according to claim 1, wherein the toggle lever is configured to actuate between the first end position and the second end position using a snap-action mechanism.

12. The rotary drive according to claim 1, wherein the mounting plate includes a part of a door or flap of a switching cabinet, and the shaft is disposed on the switch base and the rotary knob is disposed on the part of the mounting plate so that the rotary knob disengages from the shaft when the part of the mounting plate is opened.

* * * * *